United States Patent [19]

Cavanagh

[11] 4,399,787

[45] Aug. 23, 1983

[54] ENGINE RETARDER HYDRAULIC RESET MECHANISM

[75] Inventor: Mark S. Cavanagh, Holyoke, Mass.

[73] Assignee: The Jacobs Manufacturing Company, Bloomfield, Conn.

[21] Appl. No.: 334,265

[22] Filed: Dec. 24, 1981

[51] Int. Cl.[3] ..... F02D 9/06

[52] U.S. Cl. ..... 123/321; 123/90.16

[58] Field of Search ..... 123/320, 321, 90.12, 123/90.15, 90.16

[56] References Cited

U.S. PATENT DOCUMENTS 3,405,699 10/1968 Laas ..... 123/320
3,859,970 1/1975 Dreisin ..... 123/320
4,150,640 4/1979 Egan ..... 123/90.12
4,271,796 6/1981 Sickler et al. ..... 123/321

*Primary Examiner*—William A. Cuchlinski, Jr.
*Attorney, Agent, or Firm*—Donald E. Degling

[57] ABSTRACT

An hydraulic reset mechanism is provided for an engine retarder of the compression relief type. The mechanism senses the force required to hold open an exhaust valve. When this force has decreased substantially from the force required to open the exhaust valve initially, a valve is opened in the hydraulic system to release the hydraulic pressure and permit the exhaust valve to close. The mechanism assures that the engine exhaust valves are closed, or substantially closed, prior to the normal opening of the exhaust valves at the end of the power stroke of the engine without affecting the retarding horsepower produced by the engine brake.

25 Claims, 12 Drawing Figures

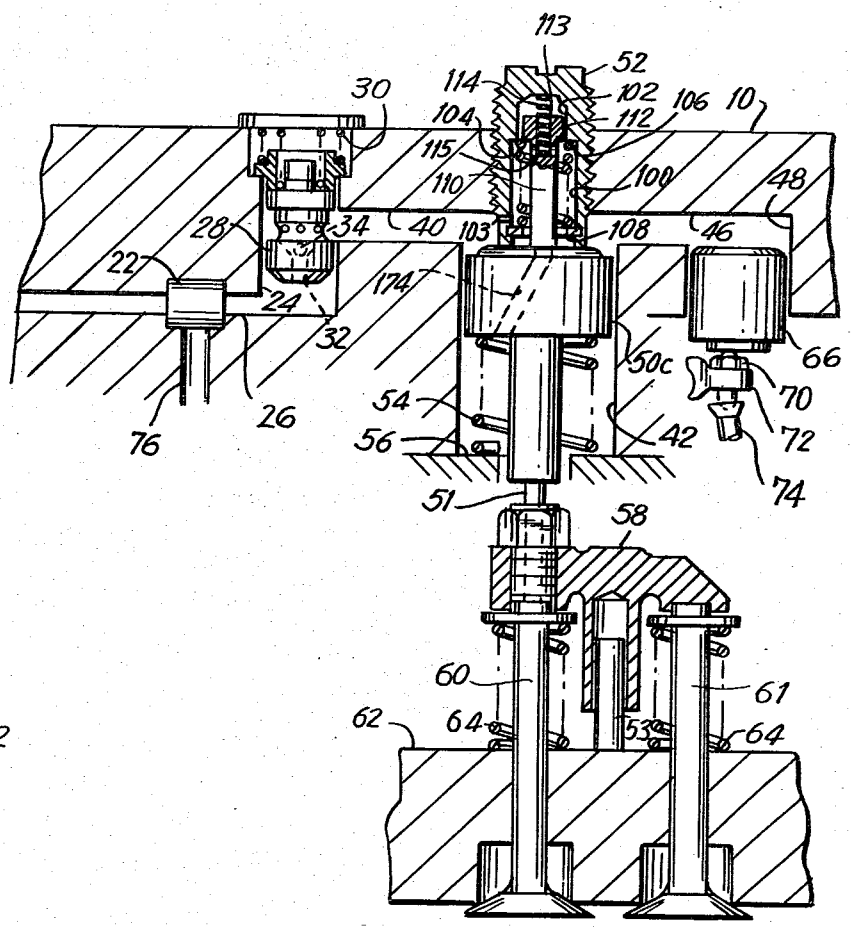
FIG. 7
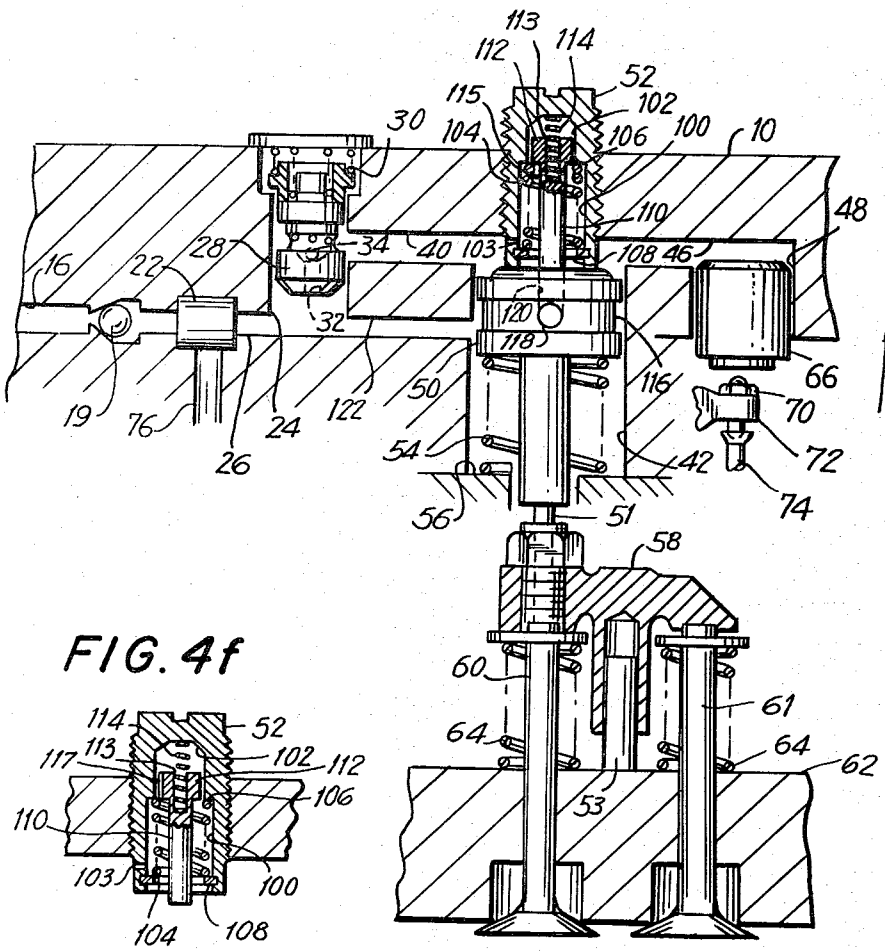
FIG. 4e
FIG. 4f

ENGINE RETARDER HYDRAULIC RESET MECHANISM

BACKGROUND OF THE INVENTION

1. Field of the Invention

This invention relates to engine retarders of the compression relief type. More particularly, the present invention relates to an hydraulic reset mechanism which insures that an exhaust valve (or valves) which was opened to produce the desired engine retarding effect is closed prior to the normal opening of the exhaust valve (or valves).

2. The Prior Art

Engine retarders of the compression relief type are well known in the art. Such retarders are designed to convert, temporarily, an internal combustion engine of the spark ignition or compression ignition type into an air compressor so as to develop a retarding horsepower which may be a substantial portion of the operating horsepower normally developed by the engine.

The basic design for an engine retarding system of the type here involved is disclosed in the Cummins U.S. Pat. No. 3,220,392. In that design, an hydraulic system is employed wherein the motion of a master piston actuated by an appropriate intake, exhaust or injector pushrod or rocker arm controls the motion of a slave piston which opens the exhaust valve of the internal combustion engine near the end of the compression stroke whereby the work done in compressing the intake air is not recovered during the expansion or "power" stroke but, instead, is dissipated through the exhaust and cooling systems.

Various improvements have been made in the original design shown in the Cummins U.S. Pat. No. 3,220,392. Laas U.S. Pat. No. 3,405,699 discloses a device to unload the hydraulic system whenever excess motion of the slave piston tends to open the exhaust valve too far and hence risk damage to the components of the engine.

Sickler et al. U.S. Pat. No. 4,271,796 discloses a pressure relief system for a compression relief engine retarder wherein a bi-stable ball relief valve and a damping mechanism rapidly drops the pressure in the hydraulic system to a predetermined low level whenever an excess pressure is sensed in the hydraulic system, thereby obviating the risk of damage to various components in the engine valve train mechanism.

U.S. patent application Ser. No. 248,344, assigned to the assignee of the present invention, discloses an improved timing mechanism for an engine retarder which produces an increased retarding power while increasing the time span between the beginning of the engine retarding action and the beginning of the normal opening of the exhaust valves of the engine.

A further improvement in engine retarder operation is disclosed in U.S. patent application Ser. No. 124,581, assigned to the assignee of the present invention. Application Ser. No. 124,581 relates particularly to engines equipped with dual exhaust valves and an engine retarder of the compression relief type and discloses apparatus to open only one of the dual exhaust valves during retarder operation while permitting both valves to be opened during normal engine operation.

As has been set forth in the patents and applications referred to above, the compression relief engine retarder uses the existing engine valve train and fuel injector mechanisms to operate the exhaust valves. However, in the apparatus of the patents and application referred to above, the exhaust valve or valves opened by the retarder may still be opene when the normal opening of the exhaust valve is timed to commence. In this event, the rocker arm may impact sharply against the crosshead or valve stem and produce a loading condition which is different, and perhaps more severe, than that originally contemplated in the design of the engine. Such a loading condition may be particularly disadvantageous in the case of engines equipped with dual exhaust valves where the engine retarder is designed to act on only one valve. In this case, the original designed symmetrical loading of the crosshead and crosshead guide is transmuted into an asymmetrical loading condition whenever one of the exhaust valves is partially open when the second exhaust valve begins to open.

SUMMARY OF THE INVENTION

In accordance with the present invention, applicants have provided an hydraulic reset mechanism which may be retrofitted into existing engine retarders of the compression relief type. The present invention also comprises a method of operating a compression relief engine retarder wherein the decrease in cylinder pressure resulting from the timed opening of at least one engine exhaust valve is sensed by the reset mechanism which thereupon releases the pressure in the hydraulic system so that the slave piston may promptly return to its rest position. In accordance with a further feature of the invention, the hydraulic fluid which actuates the slave piston may be stored within the retarder mechanism or elsewhere for use during the subsequent cycle of operation. The hydraulic reset mechanism of the present invention may be incorporated into either the slave piston adjusting screw or the slave piston. Storage of hydraulic fluid may be provided in the slave piston adjusting screw, the slave piston, in one or more of the engine retarder control valves, or in any other accumulator connected to the engine brake circuit.

BRIEF DESCRIPTION OF THE DRAWINGS

Additional advantages of the process and apparatus in accordance with the present invention will become apparent from the following detailed description of the invention and the accompanying drawings in which:

FIG. 4(*b*) is a cross-sectional view of the engine retarder and reset mechanism at the end of the stroke of the master piston when the exhaust valve has been opened, as indicated by point "b" in FIG. 3.

FIG. 4(*c*) is a cross-sectional view of the engine retarder and reset mechanism after the pressure in the hydraulic circuit has decayed so as to trip the reset mechanism, as shown, for example, by point "c" in FIG. 3.

FIG. 4(*d*) is a cross-sectional view of the engine retarder and reset mechanism after the slave piston has returned to a rest position and the exhaust valve has closed, as shown by point "d" in FIG. 3.

FIG. 4(*e*) is a cross-sectional view of the engine retarder and reset mechanism after the master piston has begun to return to its initial position and the hydraulic circuit is refilling, as shown by point "e" in FIG. 3.

FIG. 4(*f*) is an enlarged view of the hydraulic reset mechanism shown in FIGS. 4*a*–4*e* showing an alternative means for equalizing the pressure within the reset mechanism.

FIG. 7 is a cross-sectional detail of an engine retarder and hydraulic reset mechanism similar to that shown in FIG. 4(*a*) except that the excess hydraulic fluid in the hydraulic circuit is dumped during each cycle.

DETAILED DESCRIPTION OF THE INVENTION

Figure 1:
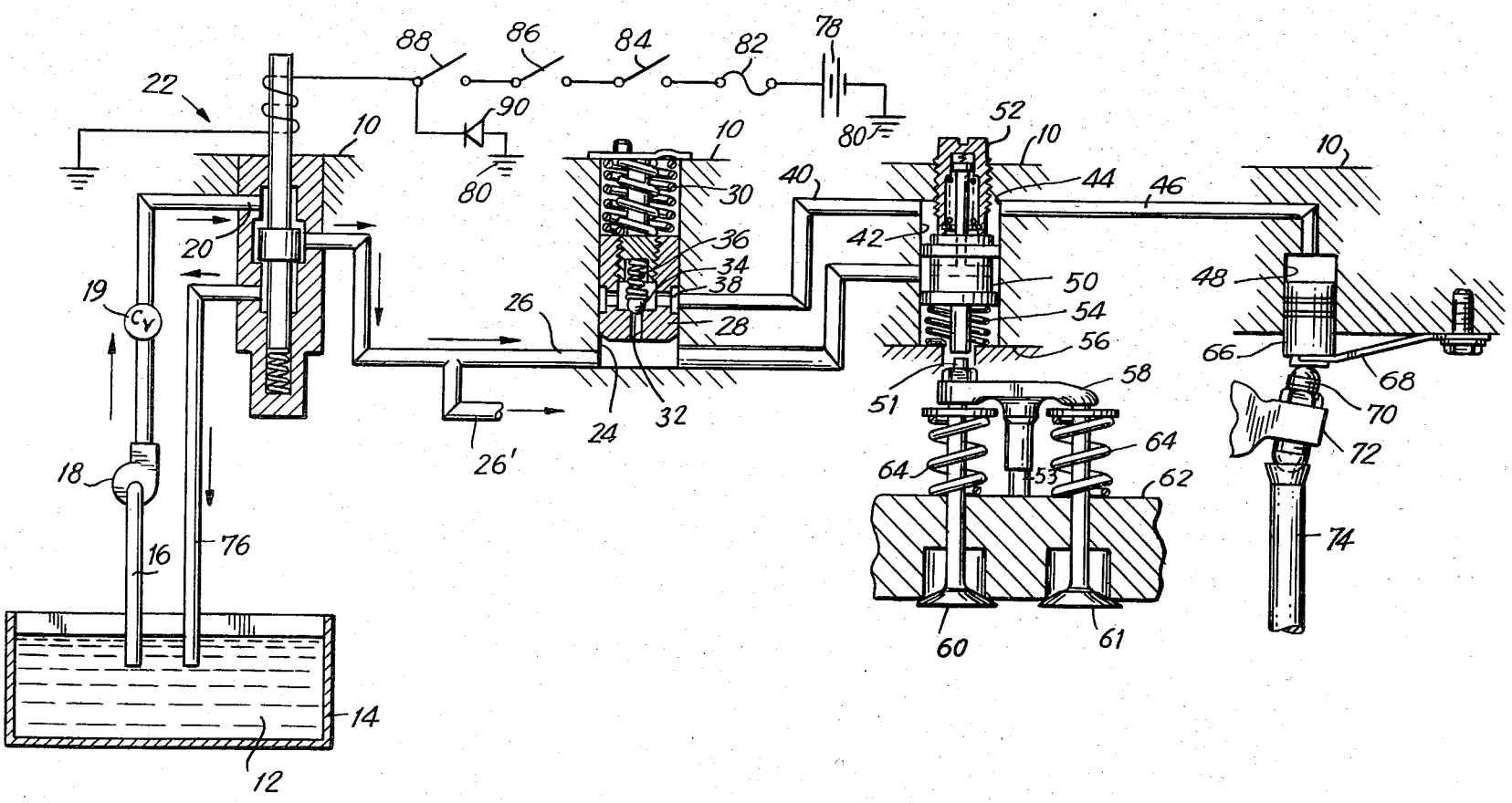
FIG. 1 is a schematic drawing of a compression relief engine retarder incorporating an hydraulic reset mechanism and storage system in accordance with the present invention.

FIG. 1 is a schematic diagram of a compression release engine retarder adapted for use in conjunction with an internal combustion engine of the spark ignition or compression ignition type. As noted above, the basic design of the compression relief engine retarder is disclosed in the Cummins U.S. Pat. No. 3,220,392. For purposes of simplicity and clarity, the present invention will be described with reference to an engine retarder applied to a Cummins compression ignition engine in which the master piston of the engine retarder is driven by the injector pushrod. It will be understood that the invention may also be applied to other engines where, for example, the master piston is driven by an exhaust valve pushrod.

Referring now to FIG. 1, the numeral 10 represents a housing fitted on an internal combustion engine within which the components of a compression relief engine retarder are contained. Oil 12 from a sump 14, which may be, for example, the engine crankcase, is pumped through a duct 16 by a low pressure pump 18 through a check valve 19 to the inlet 20 of a solenoid valve 22 mounted in the housing 10. Low pressure oil 12 is conducted from the solenoid valve 22 to a control cylinder 24 by a duct 26. A control valve 28, fitted for reciprocating movement within the control cylinder 24, is urged toward a closed position by a compression spring 30. The control valve 28 contains an inlet passage 32 closed by a ball check valve 34, which is biased into the closed position by a compression spring 36, and an outlet passage 38. When the control valve 28 is in the open position (as shown in FIG. 1), the outlet passage 38 registers with the control cylinder outlet duct 40 which communicates with the inlet of a slave cylinder 42 also formed in the housing 10. It will be understood that low pressure oil 12 passing through the solenoid valve 22 enters the control valve cylinder 24 and raises the control valve 28 to the open position. Thereafter, the ball check valve 34 opens against the bias of spring 36 to permit the oil 12 to flow into the slave cylinder 42. From the outlet 44 of the slave cylinder 42, the oil 12 flows through a duct 46 into the master cylinder 48 formed in the housing 10.

A slave piston 50 is fitted for reciprocating motion within the slave cylinder 42. The slave piston 50 is biased in an upward direction (as shown in FIG. 1) against an adjustable stop 52 by a compression spring 54 which is mounted within the slave cylinder 42 and acts against a bracket or snap ring 56 seated in the slave cylinder. The lower end of the slave piston 50 acts against a pin 51 freely journalled within a crosshead 58 which, in turn, is fitted for reciprocating motion on a guide pin 53 seated in the engine cylinder head 62. The pin 51 engages the stem of exhaust valve 60 while the crosshead 58 engages the stems of both exhaust valve 60 and exhaust valve 61. Exhaust valve springs 64 normally bias the exhaust valves 60 and 61 to the closed position as shown in FIG. 1. It will be understood that in normal engine operation a rocker arm (not shown) acts downwardly upon the crosshead 58 so as to open both exhaust valves. However, when the engine retarder is operating, the slave piston 50 acts through sliding pin 51 to open only exhaust valve 60. Normally, the adjustable stop 52 is set to provide a clearance of about 0.018 inch (i.e., "lash") between the slave piston 50 and sliding pin 51 when the exhaust valve 60 is closed, the slave piston 50 is seated against the adjustable stop 52, and the engine is cold. This clearance is required and is normally sufficient to accommodate expansion of the parts comprising the exhaust valve train when the engine is hot without opening the exhaust valve 60.

A master piston 66 is fitted for reciprocating movement within the master cylinder 48 and biased in an upward direction (as viewed in FIG. 1) by a light leaf spring 68. The lower end of the master piston 66 contacts an adjusting screw mechanism 70 of a rocker arm 72 controlled by a pushrod 74 driven from the engine camshaft (not shown). As noted above, when applied to the Cummins engine, the rocker arm 72 is conveniently the fuel injector rocker arm and the pushrod 74 is the injector pushrod. In this circumstance, the pushrod 74 and the exhaust valve 60 are associated with the same engine cylinder.

It will be understood that when the solenoid valve 22 is opened, oil 12 will raise the control valve 28 and then fill both the slave cylinder 42 and the master cylinder 48. Reverse flow of oil out of the slave cylinder 42 and master cylinder 48 is prevented by the action of the ball check valve 34. However, once the system is filled with oil, upward movement of the pushrod 74 will drive the master piston 66 upwardly and the hydraulic pressure, in turn, will drive the slave piston 50 downwardly to open exhaust valve 60. The valve timing is selected so that the exhaust valve 60 is opened near the end of the compression stroke of the cylinder with which the exhaust valve 60 is associated. Thus, the work done by the engine piston in compressing air during the compression stroke is released to the exhaust and cooling systems of the engine and is not recovered during the expansion stroke of the engine.

When it is desired to deactivate the compression relief retarder, the solenoid valve 22 is closed whereby the oil 12 in the control valve cylinder 24 passes through the duct 26, the solenoid valve 22, and the return duct 76 to the sump 14. The control valve 28 will then be urged downwardly by the spring 30 and a portion of the oil in the slave cylinder 42 and master cylinder 48 will be vented over the top of the control valve 28 and returned to the sump 14 by duct means (not shown).

The electrical control system for the engine retarder includes the vehicle battery 78 which is grounded at 80. The hot terminal of the battery 78 is connected, in series, to a fuse 82, a dash switch 84, a clutch switch 86, a fuel pump switch 88, the solenoid 22 and, preferably, through a diode 90 back to ground 80. The switches 84, 86, and 88 are provided to assure the safe operation of the system. Switch 84 is a manual control to deactivate the entire system. Switch 86 is an automatic switch connected to the clutch to deactivate the system whenever the clutch is disengaged so as to prevent engine stalling. Switch 88 is a second automatic switch connected to the fuel system to prevent engine fueling when the engine retarder is in operation.

Figure 2:
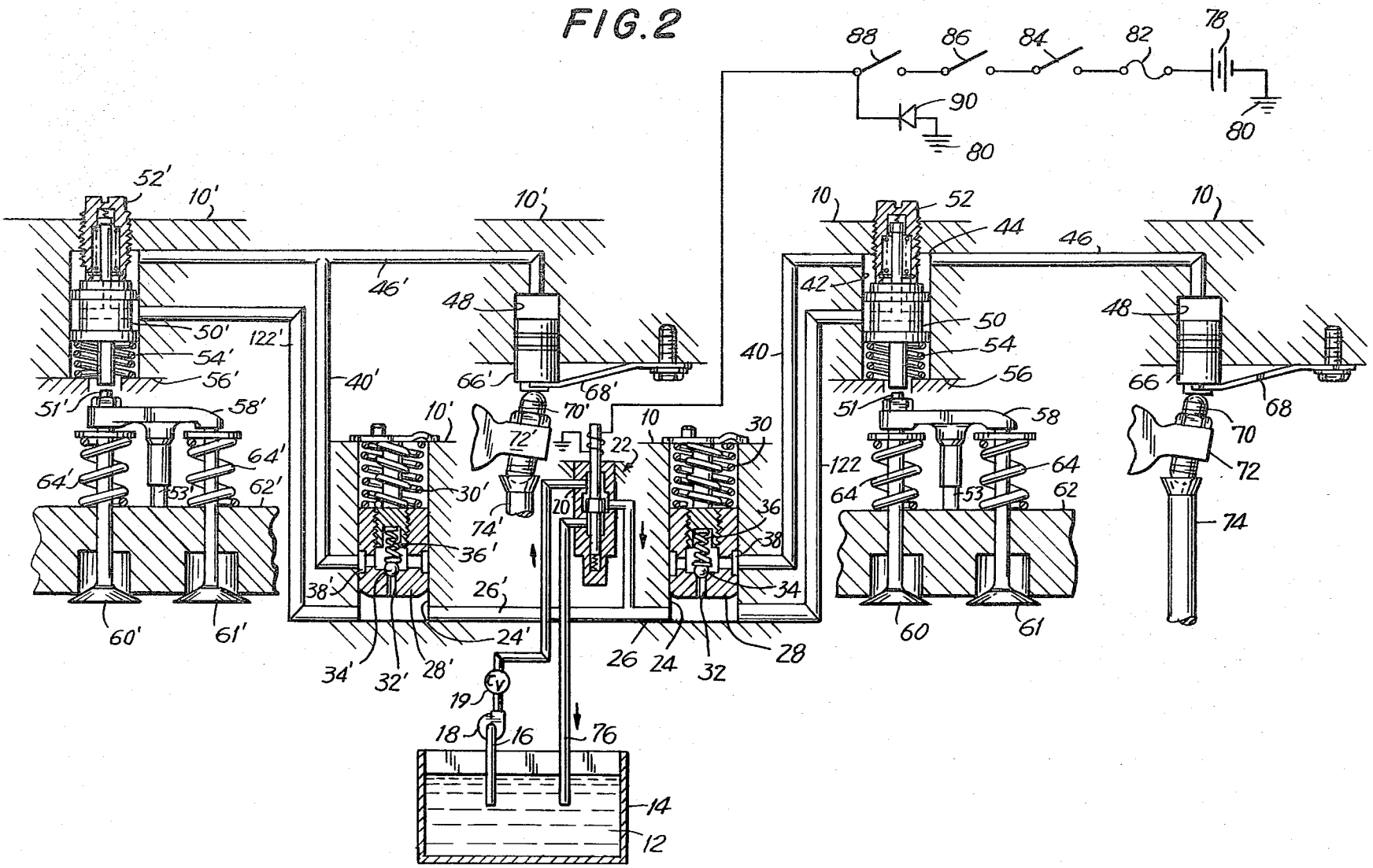
FIG. 2 is a schematic drawing of a compression relief engine retarder interconnected between two cylinders of an engine to provide a storage system utilizing two control valves.

Reference is now made to FIG. 2 which shows the control valve, master piston and cylinder, and slave piston and cylinder associated with a second cylinder of the engine in addition to the parts of the engine shown in FIG. 1. In FIG. 2, the right-hand portion is identical to the apparatus shown in FIG. 1 and bears the same nomenclature. The additional components required for the second cylinder are shown at the left and are identified by primed numbers. It will be understood that the engine retarder mechanism operates at a different time for each cylinder. The interconnection of the control valve cylinders 24 and 24' through the ducts 26 and 26' has a particular advantage as will be pointed out in detail below.

The hydraulic reset mechanism in accordance with the present invention may be incorporated into the slave piston 50 or the slave piston adjusting screw 52 and may, in addition, utilize the control valves 28 and 28'. Before describing the hydraulic reset mechanism in detail, it may be helpful to refer to FIG. 3 which is a graph showing the movement of an exhaust valve 60 under different operating conditions. The curve 92 identified by the symbols "xxx" depicts the normal motion of an exhaust valve 60 when the engine is operating in the fueling mode. The solid curve 94 represents the motion of the exhaust valve 60 with an engine retarder of the type described hereinabove. The significant factor involved here is that the exhaust valve is partially open when the normal exhaust valve opening sequence begins. It is this condition that may result in the operating difficulties set forth above. Curve 96, identified by the dashed line, shows the operation in accordance with the present invention. As shown by curve 96, the exhaust valve 60 is closed or substantially closed, prior to the normal exhaust valve opening sequence. As a result, the engine retarder mechanism has no effect on the normal operation of the exhaust valve train mechanism.

FIG. 4(*a*) illustrates the engine retarder mechanism in accordance with the present invention at the beginning of a cycle of operation of the exhaust valve after the mechanical lash in the system has been taken up. This is also shown as point "a" on FIG. 3 and follows the initial or rest position of the mechanism indicated by "i" on FIG. 3. In the form of the invention shown in FIG. 4(*a*) (and FIGS. 1 and 2), the hydraulic reset mechanism is contained, principally, in the slave piston adjusting screw 52. The adjusting screw 52 is formed with a first bore 100 which is bored partway through the adjusting screw 52 from the end which contacts the slave piston 50. A second narrower bore 102 extends more deeply into the adjusting screw 52. A bore 103, or other passageway, in the body of the adjusting screw 52 serves to equalize the pressures within and without the adjusting screw. A compression spring 104 seats, at one end, on the shoulder 106 formed between the bores 100 and 102 and at the other end on a snap ring 108 seated in a groove formed on the inside wall of bore 100. A reset pin valve 110 having an enlarged head 112 is mounted for reciprocating movement within the adjusting screw 52. The pin valve 110 is biased downwardly against the slave piston 50 by a relatively light compression spring 114 mounted between the end of the bore 102 and an axial bore 113 in the head 112 of the pin valve 110. A diametral hole 115 connecting with the axial bore 113 in the pin valve 110 provides a means of communication between the bores 100 and 102 so as to equalize the hydraulic pressure in bores 100 and 102. The pressure equalizing function of the bore 115 in conjunction with the axial bore 113 can be provided by other equivalent means. For example, as shown on FIG. 4(*f*) one or more longitudinal channels 117 on the outer periphery of the head 112 of the pin valve 110 extending from the head end to the body end of the head 112 will also perform the pressure equalizing function. The head 112 of the pin valve 110 and the compression spring 104 are dimensioned so that movement of the head 112 of pin valve 110 in a downward direction beyond the shoulder 106 will cause the pin valve 110 to engage and to begin to compress the spring 104.

The slave piston 50 is formed with a circumferential groove 116, a diametral hole 118 communicating with the groove 116 and an axial hole 120 communicating with the diametral hole 118. The axial hole 120 is smaller in diameter than the body portion of pin valve 110 so that when the pin valve 110 is seated against the head of the slave piston 50 the axial hole 120 is sealed. A duct 122 is provided in the housing 10 which communicates between the control valve cylinder 24 (and the duct 26) and the circumferential groove 116 of the slave piston. It will be understood that the holes 120 and 118, the groove 116, and the duct 122 provide a means of communication between the high pressure side of the hydraulic system comprising the master cylinder 48 above the master piston 66, the slave cylinder 42 above the slave piston 50, and the interconnecting ducts 40 and 46 on the one hand and the low pressure side of the hydraulic system including the duct 26 and the control valve cylinder 24 under the control valve 28. This means of communication is controlled by the reset pin valve 110.

More specifically, in the position illustrated by FIG. 4(*a*), the slave piston is positioned against the pin 51, the exhaust valve 60 is closed, the master piston 66 has just begun to move so as to take up the lash in the mechanism, and the hydraulic fluid within the high pressure side of the circuit, including the bores 100 and 102, is under relatively low pressure. The pin valve 110 is biased against the axial hole 120 by spring 114 and a force proportional to the difference between the area of the body of the valve 110 and the area of the axial hole 120 times the pressure in the high pressure system.

Figure 3:
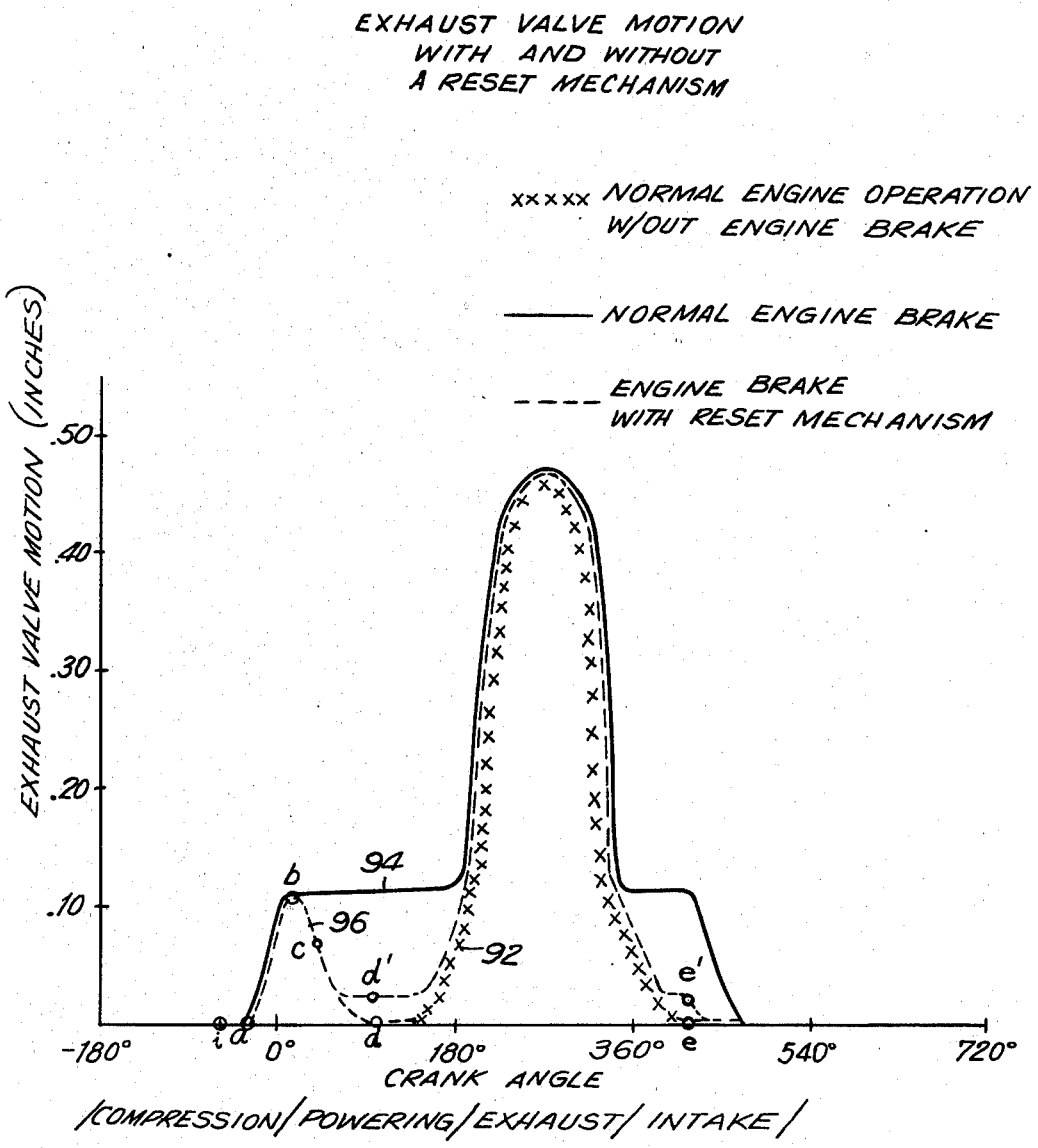
FIG. 3 is a graph showing the motion of an exhaust valve with and without the reset mechanism in accordance with the present invention.
Figure 4B:
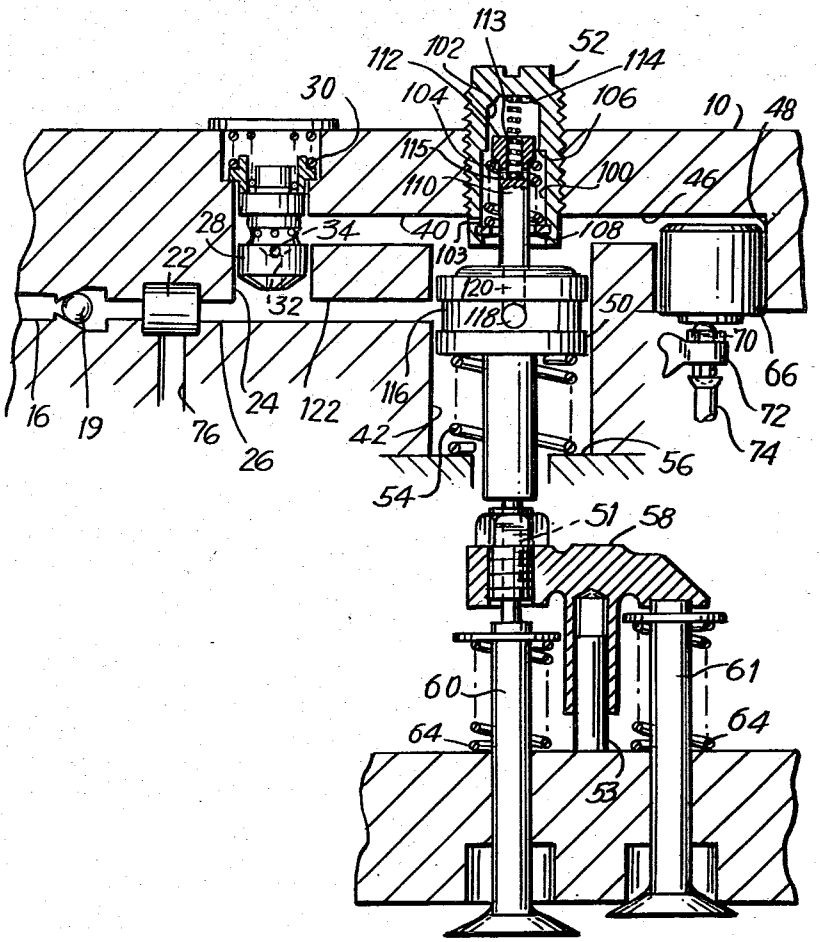
FIG. 4(*a*) is an enlarged cross-sectional detail of the engine retarder and hydraulic reset mechanism in a position shown in point "a" of FIG. 3, prior to opening the exhaust valve but after the lash in the mechanism has been taken up.
Figure 4A:
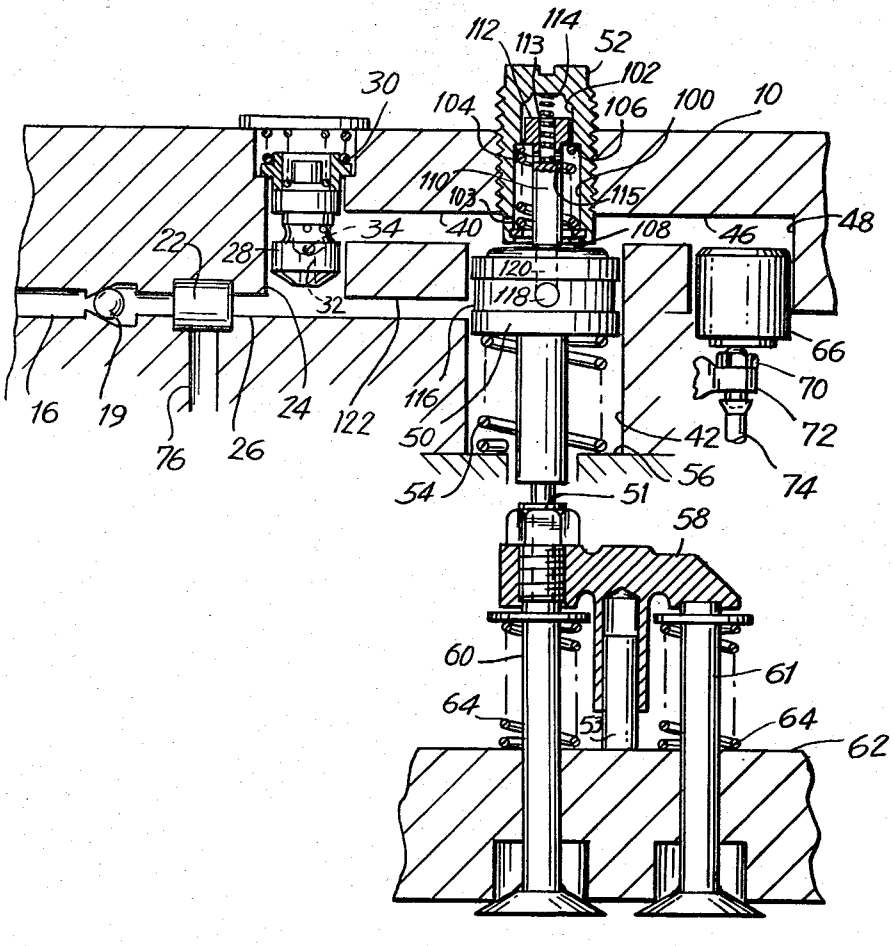
Figure 4D:
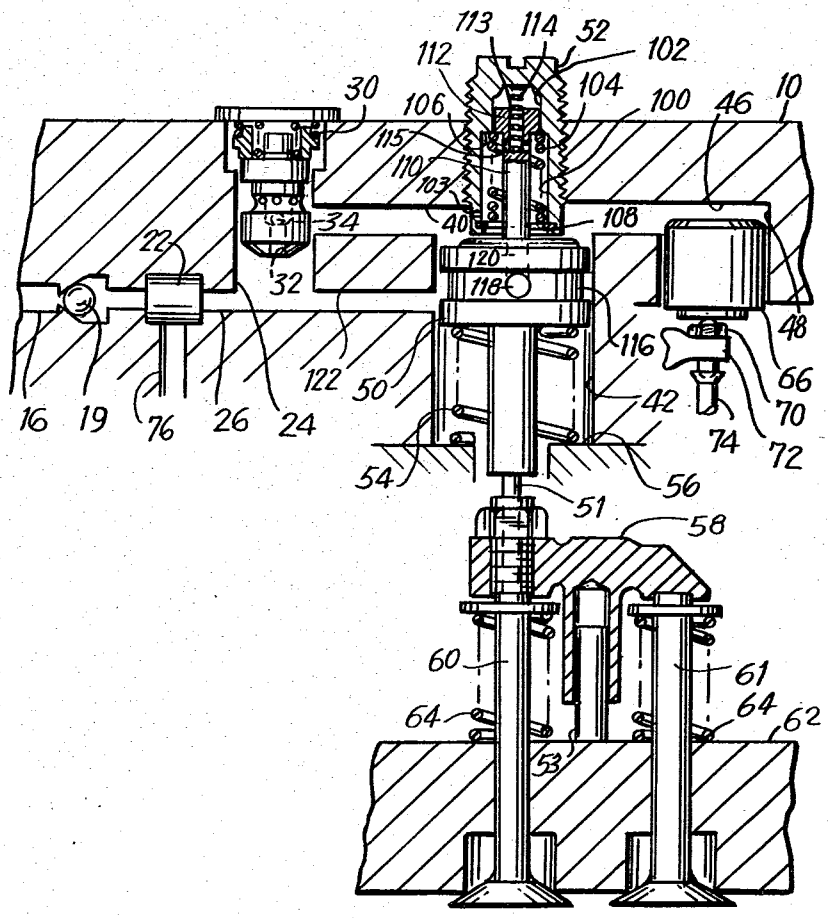
Figure 4C:
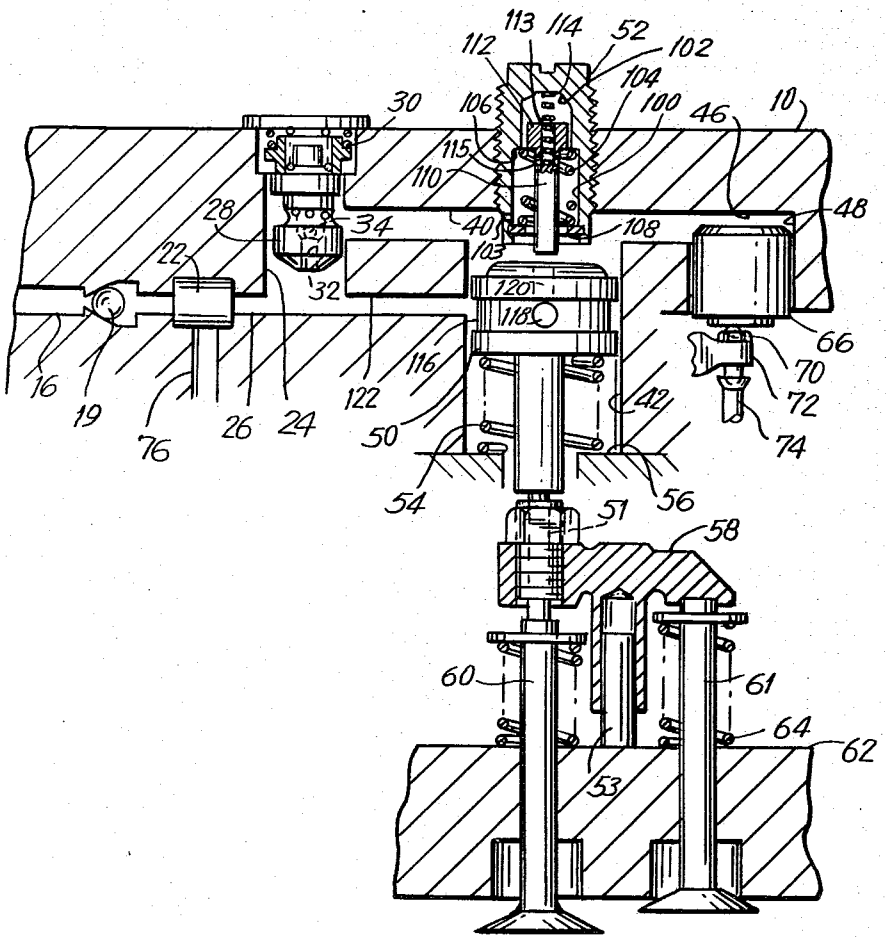

As the master piston 66 moves to its uppermost position, FIG. 4(*b*), the pressure in the high pressure circuit rises and a sufficient force is exerted to move the slave piston 50 further in a downward direction so as to open exhaust valve 60. FIG. 3 illustrates the movement of the exhaust valve from its initial closed position (FIG. 3, point "a" and FIG. 4(*a*), to its retarder actuated position (FIG. 3, point "b" and FIG. 4(*b*)). However, during this period the sealing force on the reset valve 110 increases with the hydraulic pressure so that the axial hole 120 remains sealed even though the spring 104 begins to exert an upward or opening force on the reset valve 110.

Once the exhaust valve 60 has been opened, the pressure in the engine cylinder decreases rapidly. This results in a decrease in the force on the exhaust valve 60 which is reflected as a decay in the pressure within the high pressure side of the engine retarder mechanism. When the opening force exerted by the spring 104 exceeds the closing force of the spring 114 and the hydraulic pressure, the reset valve 110 opens and the high pressure hydraulic fluid is bled through the slave piston via holes 120 and 118 and groove 116 through the duct 122 to the control valve cylinder 24. Thus, the hydraulic fluid is transferred from the high pressure circuit to the low pressure circuit where it is stored by lifting the control valve 28. The hydraulic fluid cannot flow back into duct 16 because of check valve 19. A point at which the reset valve has opened is illustrated in FIG. 4(*c*) (and point "c" of FIG. 3), while the point at which the slave piston has come to rest against the reset valve 110 is shown in FIG. 4(*d*) (and point "d" of FIG. 3). Depending upon the specific pressure conditions, the reset valve may be triggered at any point after the exhaust valve 60 has begun to open and bled down the pressure within the engine cylinder. With respect to FIGS. 4(*c*) and 4(*d*), it is to be noted that the master piston 66 has remained in its uppermost position because its motion is determined by the action of the injector pushrod 74 which cannot be altered. However, the movement of the slave piston 50 has caused it to reseat against the reset valve 110 which has moved out of the influence of the spring 104. As shown in FIG. 4(*d*) and point "d" in FIG. 3, the exhaust valve 60 is closed and the slave piston 50 is seated against the end of the reset valve 110 but not against the adjusting screw 52. The clearance between the slave piston 50 and the adjusting screw 52 is equal to the "lash" in the mechanism under the operating condition of the engine at this time. In some circumstances, it may be desirable to hold the exhaust valve slightly open as suggested by point "d'" in FIG. 3. This may be accomplished by lengthening the body portion of the reset valve 110 so that when the bottom of the head 112 of the valve reaches the shoulder 106 of the adjusting screw 52 and the influence of the spring 104 ceases, the exhaust valve 60 will not quite have seated. It will be understood that as soon as the valve 110 seals the axial hole 120, the piston 50 will come to rest because the hydraulic fluid completely fills the slave cylinder 42 and ducts 40 and 46 and cannot escape. By use of this feature, exhaust valve seating velocities will be controlled by the injector cam profile instead of the bleed off rate which is controlled by the sizing of the slave piston holes 118 and 120.

Finally, reference may be made to FIG. 4(*e*) which shows the last step in the cycle when the master piston has begun to return to a rest position and the pressure within the retarder hydraulic circuit has approached its original level. The downward movement of the master piston 66 permits the slave piston 50 to seat against the adjusting screw 52 and causes some of the hydraulic fluid stored below the control valve 28 to pass through the ball check valve 34 and back into the high pressure circuit.

Referring again to FIG. 3 and FIGS. 4(*d*) and 4(*e*), it will be observed that between the times represented by points "d" (or "d'") and "e" (or "e'") the engine retarder mechanism does not act upon the exhaust valve to any substantial extent and, therefore, has a minimal or no effect on the valve train mechanism. More particularly, the engine retarder mechanism is specifically and positively disabled from causing any substantial impact loading or significant unbalanced force in the valve train mechanism. As shown by FIG. 3, the normal exhaust valve action takes place within the time interval defined by points "d" and "e".

In FIGS. 4(*a*)–4(*e*) it was pointed out that the hydraulic fluid which became excess for a portion of the cycle was conveniently stored under the control valve 28. However, in certain engine retarder mechanisms, the diameter of the control valve 28 may be smaller than the diameter of the slave piston 50 so that there is insufficient volume available to store the requisite amount of fluid. In such event, the arrangement shown in FIG. 2 may be employed. As shown in FIG. 2, the engine retarder mechanisms for two cylinders (or, in some cases, three cylinders) may be interconnected so as to be operated by a single solenoid valve 22. This is feasible because the cylinders reach the end of their compression strokes at different times and, therefore, one retarder mechanism will be non-operating when the other retarder mechanism is required to function. With this arrangement both control valve cylinders (24 and 24') are available for storage purposes.

Figure 5:
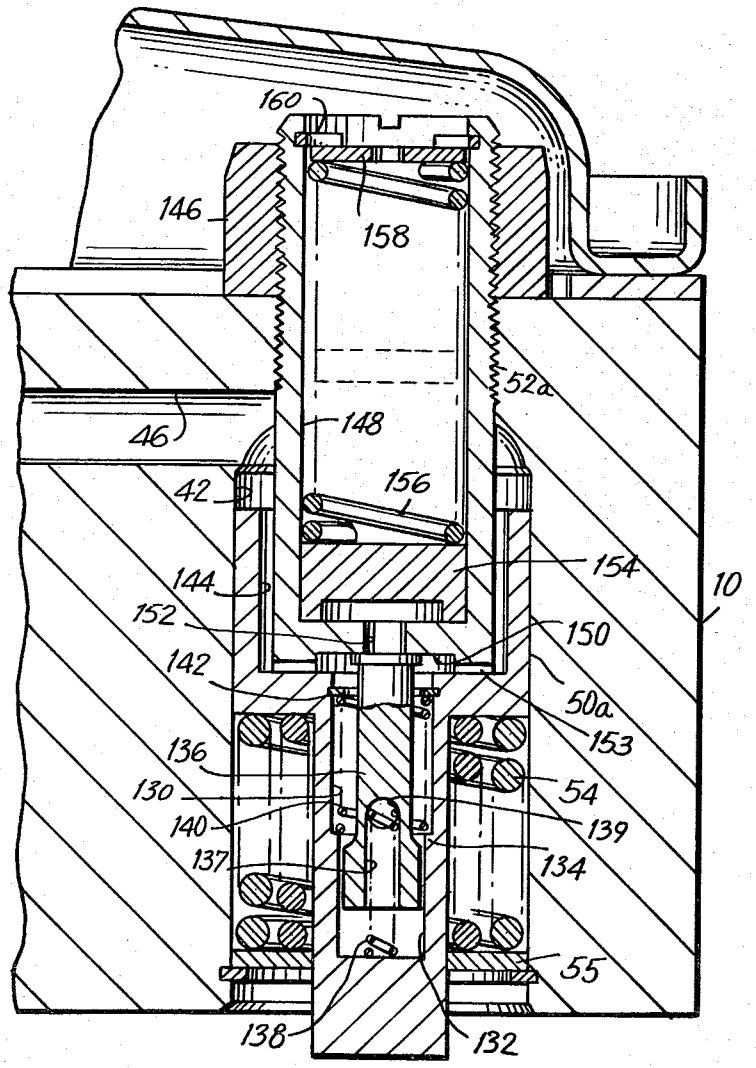
FIG. 5 is a further enlarged cross-sectional view of a reset mechanism in accordance with the present invention wherein the reset mechanism is incorporated into the slave piston and an oil storage chamber is provided in the slave piston adjusting screw.

Another form of the present invention is illustrated in FIG. 5. In this version, the reset valve is formed within the slave piston while the adjusting screw is modified to provide a storage function. Referring to FIG. 5, the slave piston 50(*a*) is mounted for reciprocation in the slave cylinder 42 which communicates through a duct 46 with the master cylinder (not shown). The slave piston 50(*a*) is biased upwardly against the adjusting screw 52(*a*) by a spring or springs 54 which act against a snap ring mounted plate 55. Two coaxial bores 130 and 132 are formed in the slave piston 50(*a*) so as to define a shoulder 134 therebetween. A pin valve 136 is mounted for reciprocating movement within the bore 132 and lightly biased in an upward direction (as viewed in FIG. 5) by a compression spring 138. The pin valve 136 is provided with an axial bore 137 which communicates with a diametral bore 139. The bores 137 and 139 serve to equalize the hydraulic pressure in bores 130 and 132. Bore 137 additionally functions as a seat for spring 138. A second compression spring 140 is seated between the shoulder 134 and a snap ring 142 affixed in the bore 130. The compression spring 140 and the pin valve 136 are sized so that movement of the pin valve 136 in an upward direction will result in engagement with the compression spring 140 and a resultant bias in a downward direction.

The slave piston 50(*a*) is provided with a third bore 144, coaxial with bores 130 and 132, but larger than either of the latter bores. The base of bore 144 serves as a seat by which the slave piston 50(*a*) contacts the adjusting screw 52(*a*). Adjusting screw 52(*a*) is threaded into the housing 10 and may be locked into the desired adjustment by a lock nut 146. A bore 148 is formed within and partway through the adjusting screw, while the lower outer end of the adjusting screw is relieved so as to form a shallow cylindrical chamber 150. An orifice 152 communicates between the bore 148 and the chamber 150. A channel 153 formed in the base of the adjusting screw 52*a* communicates between the chamber 150 and bore 144 in slave piston 50*a*. Pin valve 136 has a diameter which is greater than that of the orifice 152 and functions to seal orifice 152 whenever pin valve 136 and orifice 152 are juxtaposed. A piston 154 is mounted for reciprocal movement within the bore 148 of the adjusting screw 52(*a*) and biased in a downward direction by a compression spring 156 seated between the piston 154 and a washer 158 held within the bore 148 by a snap ring 160.

In operation, hydraulic fluid enters the slave cylinder 42 through duct 46 and urges the slave piston 50(*a*) downwardly against the bias of the valve train mechanism (not shown) and compression springs 54. However, hydraulic fluid is at all times connected to bores 130 and 132 and, together with spring 138, maintains an upward bias on the pin valve 136 so as to seal the orifice 152. Continued motion of the slave piston 50(*a*) causes the spring 140 to engage the pin valve 136 and exert an additional force tending to open the pin valve 136 but insufficient to do so when the pressure of the hydraulic fluid is high. Such a condition occurs between the points "a" and "b" of FIG. 3. When, however, the pressure decays, as shown at point "c" of FIG. 3, the force of spring 140 is sufficient to snap open the pin valve 136 and the hydraulic fluid enters the adjusting screw 52(*a*) through the orifice 152. Release of the hydraulic fluid from the slave cylinder 42 permits the slave piston 50(*a*) to return to its original position with the excess hydraulic fluid trapped in the adjusting screw 52(*a*). As noted above with respect to FIG. 4(*e*), when the master piston returns to its rest position, the spring 156 will drive the piston 154 downwardly and return the hydraulic fluid to the slave cylinder 42 through the orifice 152.

It will be appreciated that the hydraulic reset mechanism of FIG. 5 functions in essentially the same manner as that described with reference to FIG. 4 with the exception that a storage means is provided within the adjusting screw 52(*a*) in place of the storage provided by one or more control valves 28.

Figure 6:
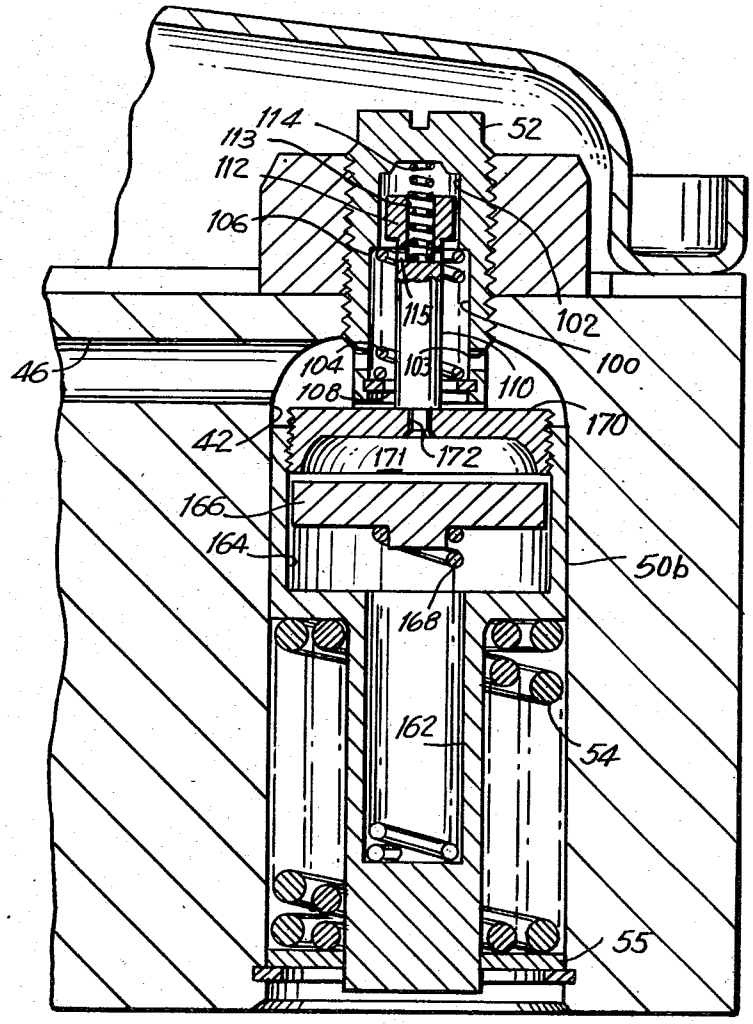
FIG. 6 is a further enlarged cross-sectional view of a reset mechanism in accordance with the present invention wherein the reset mechanism is incorporated into the slave piston adjusting screw and an oil storage chamber is provided in the slave piston.

In the event that it is desired to combine the storage feature of FIG. 5 with the reset valve mechanism of FIG. 4, an arrangement as shown in FIG. 6 may be employed. This form of the invention is fundamentally a reciprocal of the mechanism shown in FIG. 5 since the storage function is performed by the slave piston 50(*b*) while the reset valve is contained in the adjusting screw 52. Parts which are common to FIGS. 1 through 4 and 6 will be identified by the same reference characters without repetition of the description set forth above.

The slave piston 50(*b*) has formed therein a pair of concentric bores 162 and 164. A piston 166 is mounted for reciprocating movement within the bore 164 and is biased in an upward direction as viewed in FIG. 6 by a compression spring 168, one end of which is seated in the bottom of the bore 162 while the other end bears against the piston 166. A cap 170 is threaded into the upper end of the bore 164 so as to define, with the bore 164 and the piston 166, a storage chamber 171 for hydraulic fluid. A central passageway 172 formed in the cap 170 serves as a means for the ingress and egress of hydraulic fluid except when closed by the reset pin valve 110.

Operation of the apparatus shown in FIG. 6 is similar to that of FIG. 5. Upward movement of the master cylinder 66 (FIGS. 1 and 4(*a*)) forces hydraulic fluid through duct 46 into the slave cylinder 42 and drives the slave piston 50(*b*) downwardly. The reset pin valve 110 remains seated against the cap 170 of the slave piston 50(*b*) thereby sealing the passageway 172 due to the hydraulic pressure and spring 114. During its downward motion, the reset pin valve 110 engages with the compression spring 104 which exerts a bias tending to open the pin valve but which is insufficient to do so while the hydraulic pressure is high. When the hydraulic pressure begins to decay (e.g., FIG. 3, point "c") the bias of the spring 104 is sufficient to open the pin valve 110 and permit hydraulic fluid to pass through the passageway 172 into the storage chamber 171. The hydraulic fluid drives the piston 166 downwardly and is stored in the chamber 171 above the piston 166.

Because of the decreased pressure in the slave piston cylinder 42, the slave piston 50(*b*) moves in an upward direction permitting the exhaust valve 60 (FIGS. 1 and 4(*d*)) to close and re-engaging the reset pin valve 110. This return motion of the slave piston 50(*b*) occurs before the master piston 66 (FIGS. 1 and 4(*d*)) returns to its original rest position and thus the engine retarder apparatus is substantially disengaged from the valve train mechanism before the normal motion of the exhaust valve begins.

Once the master piston 66 begins to return to its rest position, the further decrease in pressure in the slave cylinder 42 will cause the hydraulic fluid stored in the slave piston 50(*b*) to return to the slave cylinder 42 through the passageway 172. At this point, the mechanism has completed its cycle of operation and is ready to begin a new cycle.

Up to this point, the description has proceeded on the premise that the supply of hydraulic fluid was insufficient to permit operation of the engine retarder with the hydraulic reset mechanism unless the hydraulic fluid released by the reset mechanism was stored for use during an ensuing cycle. While such a premise commonly obtains, it may also happen that the engine oil supply is sufficient in pressure and volume to permit dumping of high pressure oil from the slave cylinder 42 back to the sump 14 (FIG. 1). This may be accomplished by the elimination of the check valve 19 in FIGS. 4*a*–4*e* or by the modification shown in FIG. 7. In FIG. 7, parts which are common to FIGS. 1 and 4(*a*-)–4(*e*) bear the same designation. The slave piston 50(*c*) is similar to the slave piston 50 in FIG. 4(*a*) except that it requires no circumferential groove 116, diametral hole 118, or axial hole 120. Instead, a duct 174 is formed through the slave piston 50(*c*) from a point at the center of the top surface of the piston to a point on the low pressure side of the piston. It will also be appreciated that duct 122 in housing 10 may be omitted. Since the object of duct 174 is simply to provide a passageway between the high pressure region above the slave piston and a region of low pressure, it will also be understood that if the duct 122 (FIG. 4(*a*)) were redirected from the control valve cylinder 24 to any low pressure region, such as the slave cylinder 42 below the slave piston, then the slave piston 50 would perform essentially the same function as the slave piston 50(*c*) in FIG. 7. While the present invention has been described particularly with respect to an engine retarder designed to operate one exhaust valve of an engine equipped with dual exhaust valves, it is also applicable to retarders for engines having single exhaust valves of retarders acting on both exhaust valves of engines using dual exhaust valves.

It will be appreciated that the present invention provides means for closing the exhaust valves as soon as their compression relief function has been completed. Thus, there is no loss or decrease in the retarding horsepower developed by the compression relief retarder when the present invention is employed. The prompt closing of the exhaust valve reduces the valve overlap to that originally designed into the engine prior to the addition of the engine retarder, and thus more retarding work may be extracted from the ensuing expansion stroke of the engine. Thus, the total retarding horsepower will be increased through application of the present invention.

The reduction of valve overlap also provides another important advantage. This is that the improved compression relief retarder is more compatible with the concomitant use of an exhaust brake or a diverter valve coupled with a twin entry exhaust driven turbocharger. Either of these combinations will result in a further increase in the retarding horsepower which may be developed by the engine.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. In an engine retarding system of a gas compression relief type including an internal combustion engine having exhaust valve means and pushrod means, hydraulically actuated first piston means having high and low pressure sides associated with said exhaust valve means to open said exhaust valve means at a predetermined time and moveable between first and second positions, second piston means actuated by said pushrod means and hydraulically interconnected with said first piston means, adjustable stop means disposed in abutment with said first piston means when said first piston means is in said first position, and control valve means having high and low pressure sides hydraulically interconnected with said first and second piston means at the high pressure side thereof, the improvement comprising an hydraulic reset mechanism operable in response to first and second pressure conditions, said hydraulic reset mechanism comprising a passageway communicating at one end with said high pressure side of said first piston means and communicating at the opposite end with said low pressure side of said first piston means, pin valve means mounted for coaxial movement with respect to said first piston means and adapted to contact said passageway at the high pressure end thereof so as to seal off said passageway, first spring means adapted to bias said pin valve means toward said high pressure end of said passageway, second spring means adapted to engage said pin valve means and to bias said pin valve means away from said high pressure end of said passageway when said pin valve means is in contact with said high pressure end of said passageway and said first piston means has moved to a point in the range of location between said second position and intermediate said first and said second positions and said exhaust valve means has opened so as to produce said second pressure condition and means to equalize the pressure at the locations of said first and second spring means.

2. An apparatus as set forth in claim 1 and comprising, in addition, storage means communicating between the low pressure end of said passageway and the low pressure side of said control valve.

3. An apparatus as set forth in claim 1 and comprising, in addition, storage means disposed within said first piston means and communicating with the low pressure end of said passageway.

4. An apparatus as set forth in claim 3, wherein said storage means comprise piston means mounted for reciprocating motion within said first piston means and biased toward the low pressure end of said passageway.

5. An apparatus as set forth in claim 4, wherein said passageway comprises an axial hole formed in said first piston means.

6. An apparatus as set forth in claim 1 and comprising, in addition, storage means disposed within said adjustable stop means and communicating with the low pressure end of said passageway.

7. An apparatus as set forth in claim 6, wherein said storage means comprise piston means mounted for reciprocating motion within said adjustable stop means and biased toward the low pressure end of said passageway.

8. An apparatus as set forth in claim 1, wherein said adjustable stop means contains first and second coaxial bores which define a shoulder therebetween and having, in addition, spring retainer means mounted within one of said bores, said second spring means seated at one end against said shoulder and at the other end against said spring retainer means, said pin valve means comprising a cylindrical body portion and a cylindrical head portion larger in diameter than said body portion, but smaller than either of said first and second bores in said adjustable stop means, said second spring means having a diameter intermediate between the diameters of the body portion and the head portion of said pin valve means.

9. An apparatus as set forth in claim 8, wherein said head portion of said pin valve means has formed therein pressure equalizing means comprising an axial bore to receive one end of said first spring means, the other end of said first spring means adapted to seat at the bottom of one of said bores in said adjustable stop means and a transverse bore communicating between said axial bore and the larger of said first and second coaxial bores.

10. An apparatus as set forth in claim 9, wherein the length of the cylindrical body portion of said valve means is greater than the depth of the larger of said first and second bores of said adjustable stop means.

11. An apparatus as set forth in claim 9, wherein said passageway comprises an axial hole formed partway through said first piston means, a diametral hole formed at least partway through said first piston means and communicating at one end with said axial hole, and a circumferential groove formed around the circumference of said first piston means and communicating with said diametral hole.

12. An apparatus as set forth in claim 8 in which said pressure equalizing means comprises at least one longitudinal channel disposed on the outer periphery of the head portion of said pin valve means and communicating between the head end and the body end of said pin valve means.

13. An apparatus as set forth in claim 12, wherein the length of the cylindrical body portion of said valve means is greater than the depth of the larger of said first and second bores of said adjustable stop means.

14. An apparatus as set forth in claim 12, wherein said passageway comprises an axial hole formed partway through said first piston means, a diametral hole formed at least partway through said first piston means and communicating at one end with said axial hole, and a circumferential groove formed around the circumference of said first piston means and communicating with said diametral hole.

15. An apparatus as set forth in claim 1, wherein first piston means contains first and second coaxial bores which define a shoulder therebetween and having, in addition, spring retainer means mounted within one of said bores, said second spring means seated at one end against said shoulder and at the other end against said spring retainer means, said pin valve means comprising a cylindrical body portion and a cylindrical head portion larger in diameter than said body portion, but smaller than either of said first and second bores in said first piston means, said second spring means having a diameter intermediate between the diameters of the body portion and the head portion of said pin valve means.

16. An apparatus as set forth in claim 15, wherein said head portion of said pin valve means has formed therein a pressure equalizing means comprising an axial bore to receive one end of said first spring means, the other end of said first spring means adapted to seat at the bottom of one of said bores in said first piston means and a transverse bore communicating between said axial bore and the larger of said first and second coaxial bores.

17. An apparatus as set forth in claim 16, wherein the length of the cylindrical body portion of said valve means is greater than the depth of the larger of said first and second bores of said first piston means.

18. An apparatus as set forth in claim 16, wherein said passageway comprises an axial hole formed through said adjustable stop means.

19. An apparatus as set forth in claim 15 in which said pressure equalizing means comprises at least one longitudinal channel disposed on the outer periphery of the head portion of said pin valve means and communicating between the head end and the body end of said pin valve means.

20. An apparatus as set forth in claim 19, wherein the length of the cylindrical body portion of said valve means is greater than the depth of the larger of said first and second bores of said first piston means.

21. An apparatus as set forth in claim 19, wherein said passageway comprises an axial hole formed through said adjustable stop means.

22. An apparatus as set forth in claim 1 wherein said passageway comprises a hole extending through said first piston means.

23. In a process for operating a compression relief engine retarder comprising hydraulically driving a piston means from a first to a second position to open mechanically an engine exhaust valve near the end of each compression stroke of the engine cylinder with which said exhaust valve is associated, the steps of sensing the decreased cylinder pressure following each opening of said exhaust valve by said piston means after the compression relief function has been completed, releasing the hydraulic pressure acting upon said piston means in response to said decreased cylinder pressure, and mechanically returning said piston means to a rest position intermediate said first and second positions whereby said exhaust valve is closed prior to the beginning of each exhaust stroke of the said engine cylinder.

24. A process as set forth in claim 23, wherein said piston means is returned to said first position.

25. A process as set forth in claim 23 and comprising, in addition, the step of mechanically returning said piston means to said first position.

* * * * *